US011713855B2

(12) United States Patent
Bu et al.

(10) Patent No.: US 11,713,855 B2
(45) Date of Patent: Aug. 1, 2023

(54) LIGHT DISTRIBUTION ELEMENT, LIGHT SOURCE MODULE AND LAMP

(71) Applicants: OPPLE LIGHTING CO., LTD., Shanghai (CN); SUZHOU OPPLE LIGHTING CO., LTD., Suzhou (CN)

(72) Inventors: Chenxi Bu, Suzhou (CN); Shuchao Li, Suzhou (CN); Yisheng Xiao, Suzhou (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 17/564,181

(22) Filed: Dec. 28, 2021

(65) Prior Publication Data

US 2022/0120395 A1 Apr. 21, 2022

Related U.S. Application Data

(63) Continuation of application No. PCT/CN2020/111264, filed on Aug. 26, 2020.

(30) Foreign Application Priority Data

Sep. 23, 2019 (CN) ..... 201910898188.9
Sep. 23, 2019 (CN) ..... 201921581548.4

(51) Int. Cl.
*F21S 8/02* (2006.01)
*F21V 5/04* (2006.01)
(Continued)

(52) U.S. Cl.
CPC ..... *F21S 8/026* (2013.01); *F21V 5/04* (2013.01); *F21V 7/0016* (2013.01); *F21Y 2115/10* (2016.08)

(58) Field of Classification Search
CPC ..... F21V 5/04; F21V 7/0016; F21V 5/045; F21V 5/046; F21V 7/0091; F21V 5/005; F21V 13/04; F21Y 2115/10; F21S 8/026
See application file for complete search history.

(56) References Cited

U.S. PATENT DOCUMENTS 7,489,453 B2 * 2/2009 Chinniah ..... F21V 7/0091 362/333
7,703,950 B2 * 4/2010 Ewert ..... C03B 11/08 362/339
(Continued)

FOREIGN PATENT DOCUMENTS

CN 104344336 A 2/2015
CN 104344337 A 2/2015
(Continued)

OTHER PUBLICATIONS

International Search Report of PCT Application No. PCT/CN2020/111264 dated Dec. 2, 2020 with English translation, (6p).

*Primary Examiner* — Peggy A Neils
(74) *Attorney, Agent, or Firm* — Arch & Lake LLP

(57) ABSTRACT

Examples of the present disclosure provide a light distribution element, a light source module and a lamp, the light distribution element includes a light entry surface, a first light exit surface and a second light exit surface, the first light exit surface is configured to receive part of light entering the light entry surface and emit the part of the light entering the light entry surface; the second light exit surface is a reflective surface, and the second light exit surface is configured to receive part of the light entering the light entry surface and reflect the part of the light entering the light entry surface; and a direction of the light emitted from the second light exit surface is different from a direction of the
(Continued)

light emitted from the first light exit surface, it can be used for key lighting and lighting ceiling areas respectively.

19 Claims, 7 Drawing Sheets

(51) Int. Cl.
*F21V 7/00* (2006.01)
*F21Y 115/10* (2016.01)

(56) References Cited

U.S. PATENT DOCUMENTS

| | | | | |
|---|---|---|---|---|
| 11,237,459 | B2 * | 2/2022 | Nanda | G02B 19/0076 |
| 2019/0204529 | A1 * | 7/2019 | Yu | G02B 7/022 |
| 2019/0323665 | A1 * | 10/2019 | Okahisa | G03B 15/05 |

FOREIGN PATENT DOCUMENTS

| | | | |
|---|---|---|---|
| CN | 208983062 | U | 6/2019 |
| CN | 110645510 | A | 1/2020 |
| CN | 210266970 | U | 4/2020 |
| WO | 2011091259 | A3 | 11/2011 |
| WO | 2016175214 | A1 | 11/2016 |

* cited by examiner

LIGHT DISTRIBUTION ELEMENT, LIGHT SOURCE MODULE AND LAMP

CROSS-REFERENCE TO RELATED APPLICATIONS

This application is based upon and claims the priority of PCT patent application No. PCT/CN2020/111264 filed on Aug. 26, 2020 which claims priority to the Chinese patent application No. 201910898188.9 filed on Sep. 23, 2019, and Chinese patent application No. 201921581548.4 filed on Sep. 23, 2019, the entire contents of which are hereby incorporated by reference herein for all purposes.

TECHNICAL FIELD

The present disclosure relates to the technical field of illumination, and particularly to a light distribution element, a light source module and a lamp.

BACKGROUND

A spot lamp is a lamp for key lighting, which is widely used in homes, shopping malls, hotels and other places. The spot lamp includes a light source and a light distribution element. The light distribution element is generally a reflective cup and/or a lens. The light distribution element enables the light source to have a narrow beam angle, so that the key lighting can be performed, and the light source can be irradiated downward to illuminate a target position.

SUMMARY

The present disclosure provides a light distribution element, a light source module including the light distribution element and a lamp including the light source module.

According to a first aspect, a light distribution element is provided. The light distribution element may include a light entry surface, a first light exit surface and a second light exit surface, the first light exit surface is configured to receive part of light entering the light entry surface and emit the part of the light entering the light entry surface; the second light exit surface is a reflective surface, and the second light exit surface is configured to receive part of the light entering the light entry surface and reflect the part of the light entering the light entry surface; and a direction of the light emitted from the second light exit surface is different from a direction of the light emitted from the first light exit surface.

According to a second aspect, a light source module is provided. The light source module may include a light source and the light distribution element mentioned above, and the light entry surface is configured to receive light emitted by the light source.

According to a third aspect, a lamp is provided. The lamp may include a shell, a light source and the light distribution element mentioned above, the light entry surface is configured to receive light emitted by the light source, and the light source, the light distribution element and the shell are assembled together.

It is to be understood that both the foregoing general description and the following detailed description are exemplary and explanatory only and are not restrictive of the present disclosure.

DETAILED DESCRIPTION

In order to make the purpose, technical solutions, and advantages of the present disclosure clearer, the technical solutions of the present disclosure will be described clearly and completely in conjunction with examples of the present disclosure and the corresponding drawings. Apparently, the described examples are only a part of the examples of the present disclosure, rather than all the examples. Based on the examples in this disclosure, all other examples obtained by those of ordinary skill in the art without creative work shall fall within the protection scope of this disclosure.

It should be understood that although terms "first", "second", "third", and the like are used in the present disclosure to describe various information, the information is not limited to the terms. These terms are merely used to differentiate information of a same type. For example, without departing from the scope of the present disclosure, first information is also referred to as second information, and similarly the second information is also referred to as the first information. Depending on the context, for example, the term "if" used herein may be explained as "when" or "while", or "in response to . . . , it is determined that".

Terms used in the present disclosure are merely for describing specific examples and are not intended to limit the present disclosure. The singular forms "one", "the", and "this" used in the present disclosure and the appended claims are also intended to include a multiple form, unless other meanings are clearly represented in the context. It should also be understood that the term "and/or" used in the present disclosure refers to any or all of possible combinations including one or more associated listed items.

Certain spot lamp may mainly emit light downward to illuminate the target position, a ceiling area may be dark, and the illumination comfort of the spot lamp is reduced. In order to improve the illumination comfort, a ceiling lamp or a light strip may be installed on the ceiling at present, the light directivity of the ceiling lamp or the light strip is low, and a small amount of light may be irradiated to the ceiling area, however, the ceiling lamp or the light strip is high in cost, the installation is inconvenient, and there is still the problem that the ceiling area is dark.

First Example

Figure 1:
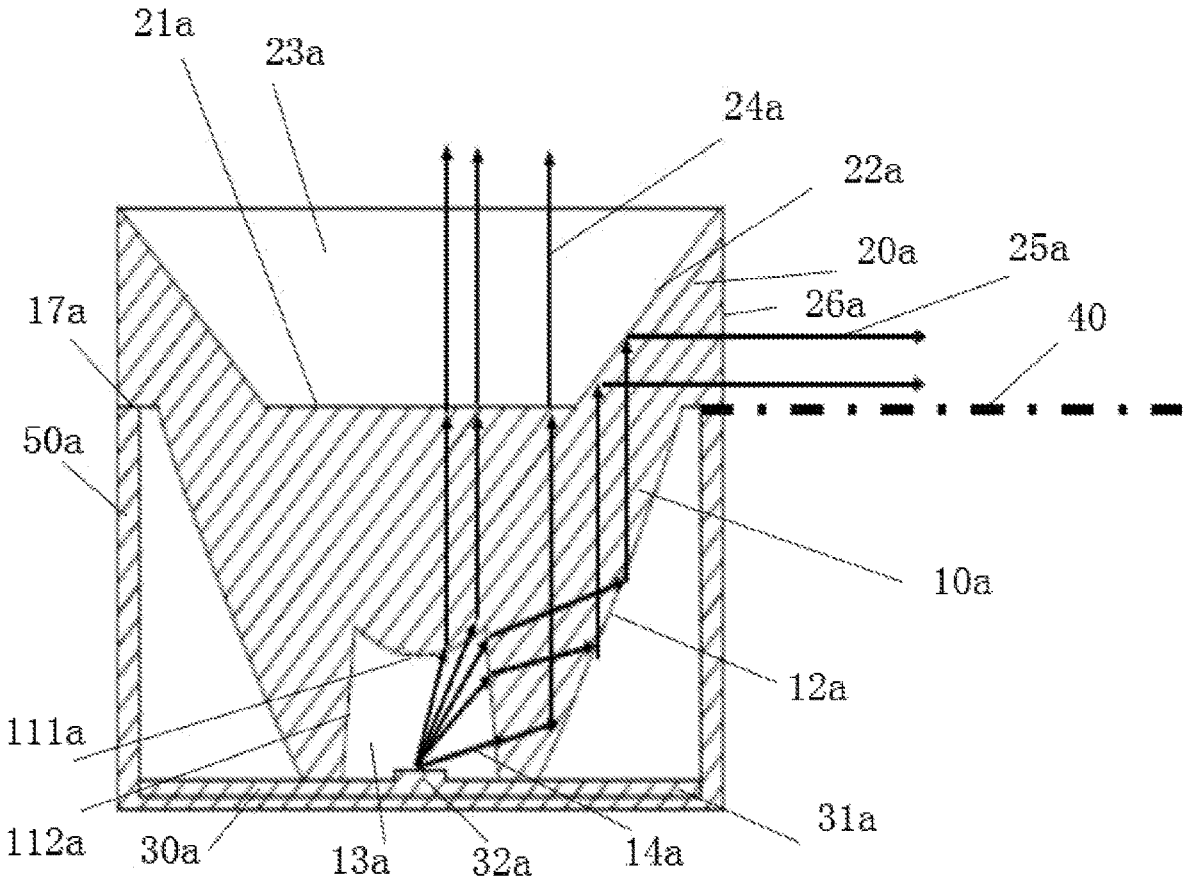
FIG. 1 is a light path diagram of a light distribution element according to a first example of the present disclosure.
Figure 2:
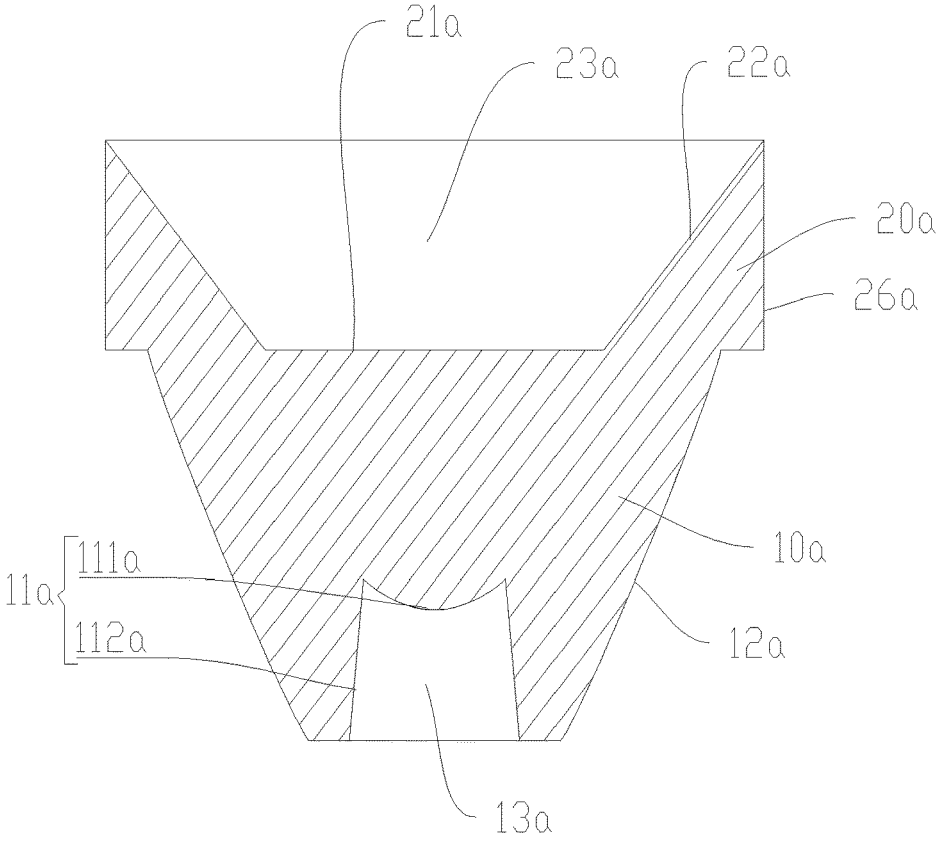
FIG. 2 is a sectional view of the light distribution element according to the first example of the present disclosure.
Figure 3:
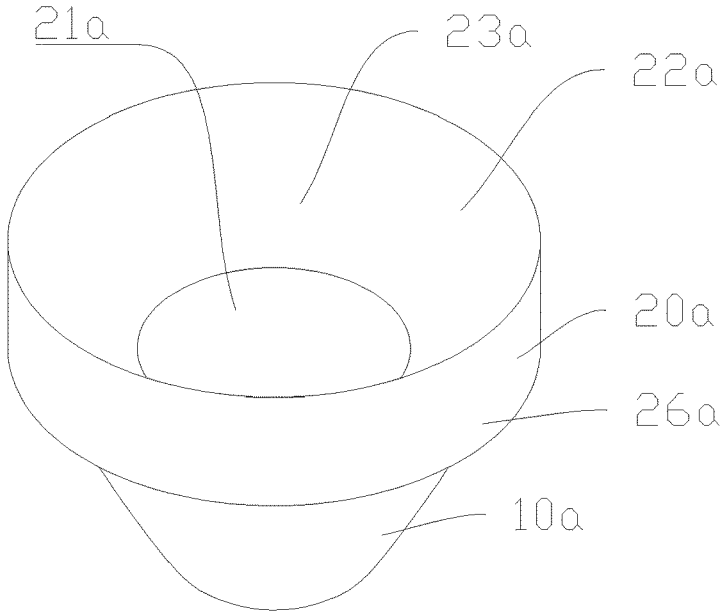
FIG. 3 is a stereoscopic diagram of the light distribution element according to the first example of the present disclosure.

As shown in FIG. 1, the present example discloses a lamp. The lamp includes a light source module. The light source module includes a light source assembly 30*a* and a light distribution element. The light source assembly 30*a* includes a light source substrate 31*a* and a light source 32*a*, and the light source 32*a* is mounted on the light source substrate 31*a*. The light distribution element includes a light entry surface 11*a*, a first light exit surface 21*a* and a second light exit surface 22*a*, and the first light exit surface 21*a* is configured to receive part of light entering the light entry surface 11*a* and emit the part of the light entering the light entry surface 11*a*; the second light exit surface 22*a* is a reflective surface, and the second light exit surface 22*a* is configured to receive part of the light entering the light entry surface 11*a* and reflect the part of the light entering the light entry surface; and a direction of the light emitted from the second light exit surface 22*a* is different from a direction of the light emitted from the first light exit surface 21*a*. The light emitted by the light source 32*a* to the light entry surface 11*a* is incident light 14*a*. The light emitted from the first light exit surface 21*a* is first exited light 24*a*, and the light reflected by the second light exit surface 22*a* is second exited light 25*a*.

The light distribution element of the present example has the advantages that 60% to 80% of the light entering the light entry surface 11*a* is emitted from the first light exit surface 21*a*, which can be used for key lighting. 20% to 40% of the light entering the light entry surface 11*a* is irradiated to the second light exit surface 22*a* and can be used to illuminate a ceiling 40 after being reflected by the second light exit surface 22*a*. After the light distribution element of the present example is applied to the lamp, the lamp can illuminate the ceiling 40 area while performing the key lighting, thereby improving the illumination comfort of the whole lamp.

The light distribution element is an integrated collimating lens. Therefore, the light entry surface 11*a*, the first light exit surface 21*a* and the second light exit surface 22*a* all are formed on the collimating lens. Two ends of the collimating lens are an inner end and an outer end respectively, and a distance between the inner end of the collimating lens and the light source substrate 31*a* is less than a distance between the outer end of the collimating lens and the light source substrate 31*a*. An inner end surface of the inner end of the collimating lens is recessed inward and encloses a light source cavity 13*a*, a bottom surface of the light source cavity 13*a* forms a first light entry surface 111*a*, and a side surface of the light source cavity 13*a* forms a second light entry surface 112*a*. The light entry surface 11*a* includes the first light entry surface 111*a* and the second light entry surface 112*a*.

The light source 32*a* faces the light source cavity 13*a*, so that the light can be irradiated to the light source cavity 13*a*. Preferably, the light source 32*a* is arranged in the light source cavity 13*a*, and the inner end surface of the inner end of the collimating lens is butted on the light source substrate 31*a*, so that the light entry surface 11*a* and the light source substrate 31*a* enclose a closed light source cavity 13*a*, which can not only increase the incident light of the light source 32*a* entering the light entry surface 11*a* and improve the light efficiency, but also prevent the light of the light source 32*a* from being irradiated into the lamp.

Preferably, the light source 32*a* is arranged at the center of the light source cavity 13*a*, so that the light emitted by the light source 32*a* can be irradiated uniformly to the light entry surface 11*a*, and the uniformity of the first exited light 24*a* and the second exited light 25*a* can be improved, thereby further improving the illumination comfort. The light source 32*a* may be an LED bead, and the number of the LED bead is preferably one. The number of the LED bead may also be multiple.

The end surface of the outer end of the collimating lens is recessed inward to form a light exit cavity 23*a*, a bottom surface of the light exit cavity 23*a* is the first light exit surface 21*a*, and the first exited light 24*a* is emitted through the light exit cavity 23*a*. The side surface of the light exit cavity 23*a* is the second light exit surface 22*a*, that is, the second light exit surface 22*a* is formed on the periphery of the first light exit surface 21*a*. The second light exit surface 22*a* is inclined outward to the first light exit surface 21*a*, and a diameter of the light exit cavity 23*a* increases gradually in a direction towards the outer end surface of the collimating lens. The second exited light 25*a* does not pass through the light exit cavity 23*a*, but deviates from the light exit cavity 23*a*. The first light exit surface 21*a* and the second light exit surface 22*a* form a continuous surface, which is conducive to improving the light exit efficiency of the light distribution element.

The collimating lens includes a first main body part 10*a* and a second main body part 20*a*; the light source cavity 13*a* is arranged at the inner end of the first main body part 10*a*, and the light exit cavity 23*a* is arranged at the outer end of the second main body part 20*a*; the outer side surface of the first main body part 10*a* is a conical surface 12*a*, and the conical surface 12*a* inclines outward; and the diameter of the first main body part 10*a* increases gradually in a direction from the inner end to the outer end.

As shown in FIG. 1, the first light entry surface 111*a* protrudes towards the inner end surface of the collimating lens; and an irradiating angle range of the light source 32*a* to the first light entry surface 111*a* may be 30 degrees to 90 degrees, and the incident light 14*a* entering the first light entry surface 111*a* is irradiated to the first light exit surface 21*a* in a direction perpendicular to the first light exit surface 21*a*, and continuously emit along the direction perpendicular to the first light exit surface 21*a* for key lighting, that is, the first exited light 24*a* is perpendicular to the first light exit surface 21*a*.

As shown in FIG. 1, the light emitted by the light source 32*a* outside the first light entry surface 111*a* is irradiated to the second light entry surface 112*a*. For example, in a case that an angle of the light emitted by the light source 32*a* to the first light entry surface 111*a* is 30 degrees, the remaining light in a total angle of 150 degrees is irradiated to the second light entry surface 112*a*. In a case that the angle of the light emitted by the light source 32*a* to the first light entry surface 111*a* is 90 degrees, the remaining light in a total angle of 90 degrees is irradiated to the second light entry surface 112*a*. Most of the incident light 14*a* entering the second light entry surface 112 is irradiated to the conical surface 12*a* and reflected totally on the conical surface 12*a* so as to be irradiated to the second light exit surface 22*a* in a direction of forming an included angle of 45 degrees with the second light exit surface 22*a*, and then the light is reflected totally on the second light exit surface 22, and further emit in a direction parallel to the ceiling 40. A small part of incident light 14*a* entering the second light entry surface 112*a* is irradiated to the conical surface 12*a*, reflected totally on the conical surface 12 and then irradiated to the first light exit surface 21*a* in a direction perpendicular to the first light exit surface 21*a*, and continuously emit along the direction perpendicular to the first light exit surface 21*a* for key lighting. The second exited light 25*a* is parallel to the surface of the ceiling 40, which has the advantage that compared with the case where an included angle is formed between the second exited light 25*a* and the surface of the ceiling 40, the second exited light 25*a* is parallel to the surface of the ceiling 40, so that a lightened area of the ceiling 40 can be enlarged. The first exited light 24*a* is perpendicular to the second exited light 25*a*. Because the ground is parallel to the ceiling 40, the first exited light 24*a* is irradiated to the ground perpendicularly for key lighting.

The light reflected by the conical surface 12*a* may be partially irradiated on the first light exit surface 21*a*, and the other part is irradiated on the second light exit surface 22*a*. The specific distribution of the light may be realized by changing parameters such as an inclination angle of the conical surface 12*a*, a position between the first light exit surface 21*a* and the conical surface 12*a*, and a position between the second light exit surface 22*a* and the conical surface 12*a*.

The outer surface of the second main body part 20*a* is a cylindrical surface 26*a*, and the second exited light 25*a* is irradiated to the cylindrical surface 26*a* in a direction perpendicular to the cylindrical surface 26*a*, and then continuously emit in a direction parallel to the ceiling 40.

Figure 4:
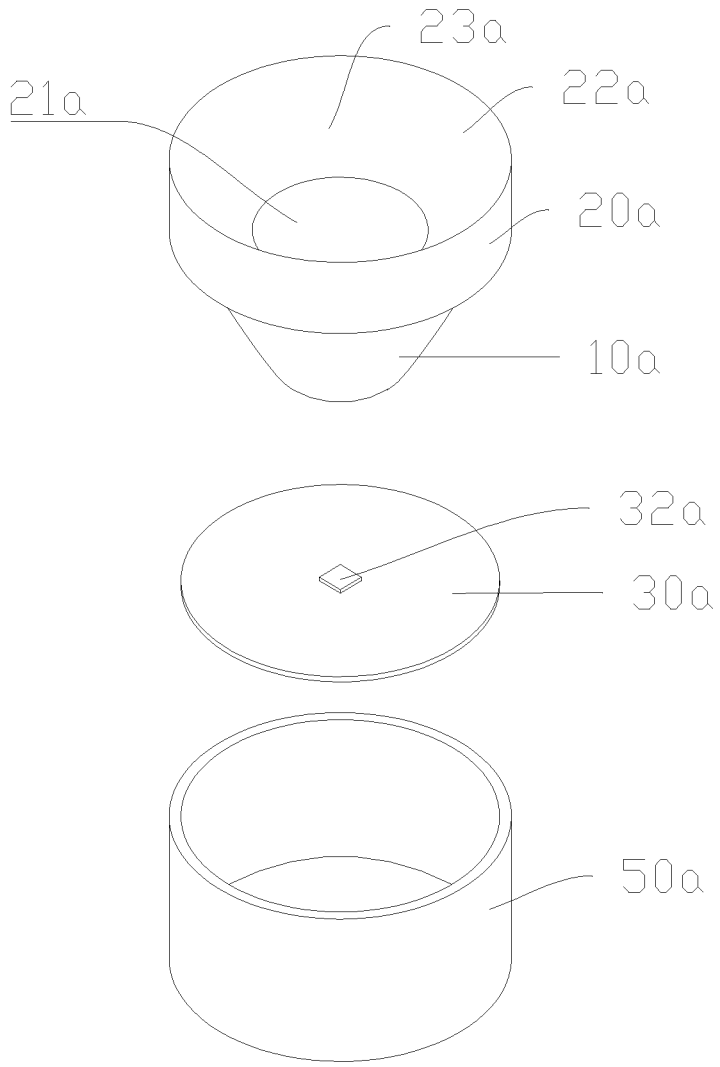
FIG. 4 is an exploded view of a lamp according to the first example of the present disclosure.

A step surface 17*a* is formed at a junction of the first main body part 10*a* and the second main body part 20*a*. As shown in FIG. 1 and FIG. 4, the lamp also includes a shell 50*a*, and the shell 50*a* is mounted in a mounting hole of the ceiling 40. The shell 50*a* is sleeved on the first main body part 10*a*. One end of the shell 50*a* has a bottom plate, and the light source substrate 31*a* is arranged on the inner surface of the bottom plate of the shell 50*a*. One end of the shell 50 with the bottom plate is a closed end, and the other end is an open end. The end surface of the open end of the shell 50*a* is butted on the step surface 17*a*, and at the time, the second light exit surface 22*a* is completely exposed outside the shell 50*a*. As shown in FIG. 1, the second light exit surface 22*a* extends out of the ceiling 40, so that all of the second exited light 25*a* can be irradiated to the ceiling 40 area. The shell 50*a* assembles the light distribution element and the light source assembly 30*a* of the present example together. The light distribution element and the light source assembly 30*a* may also be assembled through other structural members.

The above is the preferred solution of the present example, and in other examples, the first exited light 24*a* may not be perpendicular to the second exited light 25*a*. The first exited light 24*a* may also be irradiated to the ground obliquely for key lighting. The second exited light 25*a* may also be irradiated to the ceiling 40 obliquely. The direction of the first exited light 24*a* or the direction of the second exited light 25*a* may be adjusted by changing parameters such as a curvature of the first light entry surface 111*a*, an inclination angle of the second light entry surface 112*a*, an inclination angle of the conical surface 12*a*, an angle of the first light exit surface 21*a*, an inclination angle of the second light exit surface 22*a* and the like.

Second Example

Figure 5:
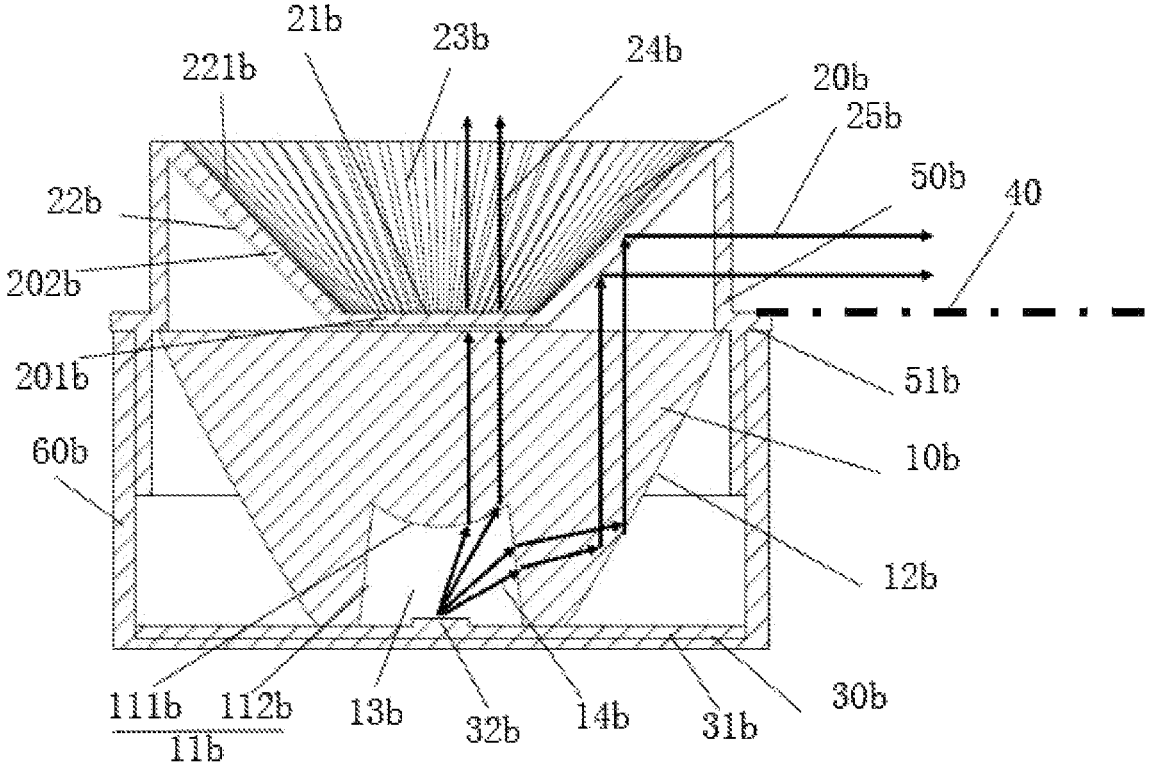
FIG. 5 is a light path diagram of a light distribution element according to a second example of the present disclosure.
Figure 6:
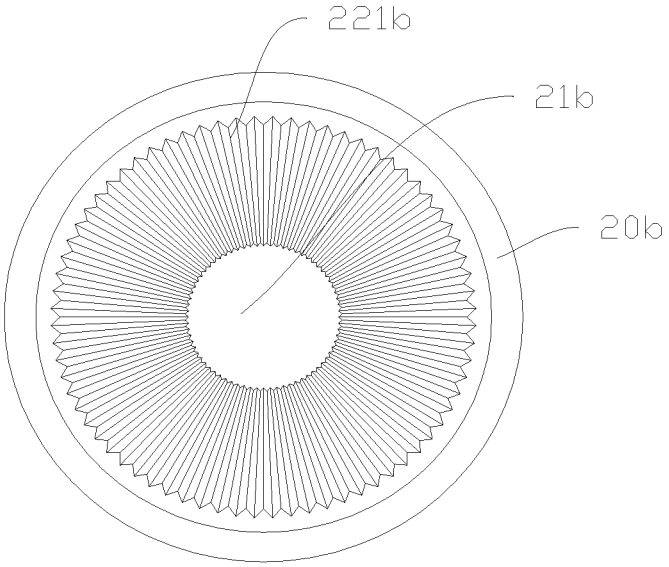
FIG. 6 is a top view of a reflector according to the second example of the present disclosure.
Figure 7:
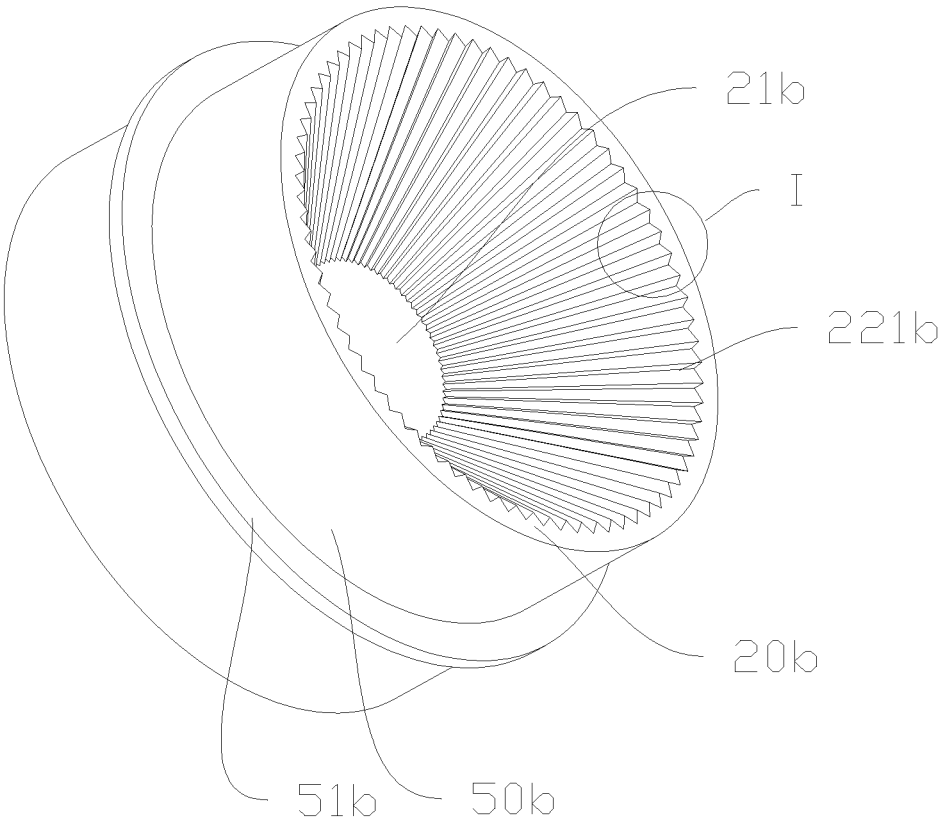
FIG. 7 is a stereoscopic diagram of the reflector according to the second example of the present disclosure.
Figure 8:
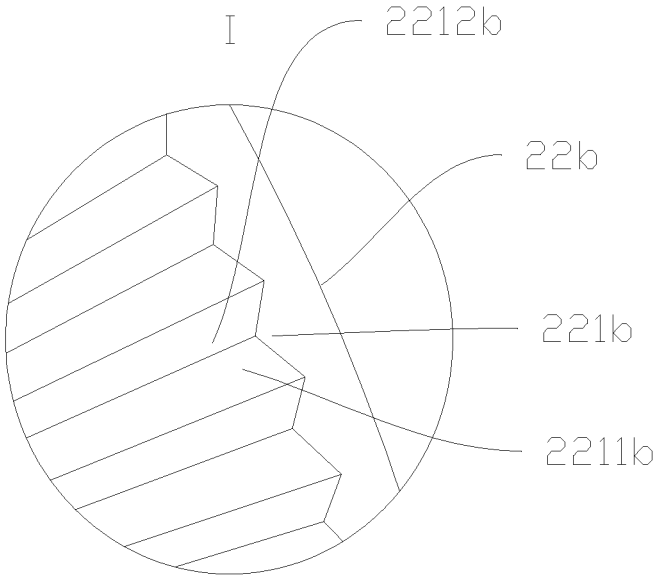
FIG. 8 is a partial enlarged view of a position I in FIG. 7.

As shown in FIG. 5, the present example discloses a lamp. The lamp includes a light source module. The light source module includes a light source assembly 30*b* and a light distribution element. The light source assembly 30*b* includes a light source substrate 31*b* and a light source 32*b*, and the light source 32*b* is mounted on the light source substrate 31*b*. The light distribution element includes a light entry surface 11*b*, a first light exit surface 21*b* and a second light exit surface 22*b*, and the first light exit surface 21*b* is configured to receive part of light entering the light entry surface 11*b* and emit the part of the light entering the light entry surface 11*b*; the second light exit surface 22*b* is a reflective surface, and the second light exit surface 22*b* is configured to receive part of the light entering the light entry surface 11*b* and reflect the part of the light entering the light entry surface 11*b*; and the direction of the light emitted from the second light exit surface 22*b* is different from the direction of the light emitted from the first light exit surface 21*b*. The light emitted by the light source 32*b* to the light entry surface 11*b* is incident light 14*b*. The light emitted from the first light exit surface 21*b* is first exited light 24*b*, and the light emitted from the second light exit surface 22*b* is second exited light 25*b*.

The light distribution element of the present example has the advantages that 60% to 80% of the light entering the light entry surface 11*b* is emitted from the first light exit surface 21*b*, which can be used for key lighting. 20% to 40% of the light entering the light entry surface 11*b* is irradiated to the second light exit surface 22*b* and can be used to illuminate a ceiling 40 after being reflected by the second light exit surface 22*b*. After the light distribution element of the present example is applied to the lamp, the lamp can illuminate the ceiling 40 area while performing the key lighting, thereby improving the illumination comfort of the whole lamp.

The present example differs from the first example in that the light distribution element of the present example includes a collimating lens 10*b* and a reflector 20*b*, and the collimating lens 10*b* and the reflector 20*b* are detachably connected. The collimating lens 10*b* has the advantage that the first exited light 24*b* and the second exited light 25*b* are convenient to control, and compared with other light distribution elements, the first exited light 24*b* can be irradiated to the ground perpendicularly with lower cost, and the second exited light 25*b* is irradiated to the ceiling 40 area in a direction parallel to the ceiling 40.

A distance between the inner end of the collimating lens 10*b* and the light source substrate 31*b* is less than a distance between the outer end of the collimating lens 10*b* and the light source substrate 31*b*. The light entry surface 11*b* is arranged at the inner end of the collimating lens 10*b*. The reflector 20*b* is arranged at the outer side of the collimating lens 10*b*, that is, the reflector 20*b* is arranged at one side of the collimating lens 10*b* facing away from the light source 32*b*. A distance between the inner end of the reflector 20*b* and the collimating lens 10*b* is less than a distance between the outer end of the reflector 20*b* and the collimating lens 10*b*. The first light exit surface 21*b* and the second light exit surface 22*b* are arranged on the reflector 20*b*.

An inner end surface of the inner end of the collimating lens 10*b* is recessed inward and encloses a light source cavity 13*b*, a bottom surface of the light source cavity 13*b* forms a first light entry surface 111*b*, and a side surface of the light source cavity 13*b* forms a second light entry surface 112*b*. The light entry surface 11*b* includes the first light entry surface 111*b* and the second light entry surface 112*b*.

The light source 32*b* faces the light source cavity 13*b*, so that the light can be irradiated to the light source cavity 13*b*. Preferably, the light source 32*b* is arranged in the light source cavity 13*b*, and the inner end surface of the inner end of the collimating lens 10*b* is butted on the light source substrate 31*b*, so that the light entry surface 11*b* and the light source substrate 31*b* enclose a closed light source cavity 13*b*, which can not only increase the incident light of the light source 32*b* entering the light entry surface 11*b*, but also prevent the light of the light source 32*b* from being irradiated into the lamp.

The reflector 20*b* includes a bottom plate 201*b* and a coaming 202*b*, the bottom plate 201*b* and the coaming 202*b* form a light exit cavity 23*b*, and the inner surface of the bottom plate 201, that is the bottom surface of the light exit cavity 23*b* is the first light exit surface 21*b*. The inner surface of the coaming 202*b* is provided with sawteeth 221*b*, and the outer surface of the coaming 202*b* is a second light exit surface 22*b*. The first light exit surface 21*b* and the second light exit surface 22*b* form a continuous surface, which is conducive to improving the light exit efficiency of the light distribution element. In other examples, the sawteeth 221*b* may also be formed on the outer surface of the coaming 202*b*.

The coaming 202*b* is inclined outward relative to the bottom plate 201*b*, so that the diameter of the reflector 20*b* increases gradually in a direction from the inner end to the outer end. The sawteeth 221*b* are arranged on the inner surface of the coaming 202*b* along a circumferential direction, and two ends of each sawtooth 221*b* extend towards two ends of the coaming 202*b* respectively; and preferably, two ends of each sawtooth 221*b* extend to the two ends of the coaming 202*b*, so that the light irradiated on the coaming 202*b* can be reflected totally, and the totally-reflected light illuminates the ceiling 40 area. The sawtooth 221*b* includes two connected tooth surfaces, and the two tooth surfaces are a first tooth surface 2211*b* and a second tooth surface 2212*b*.

Figure 9:
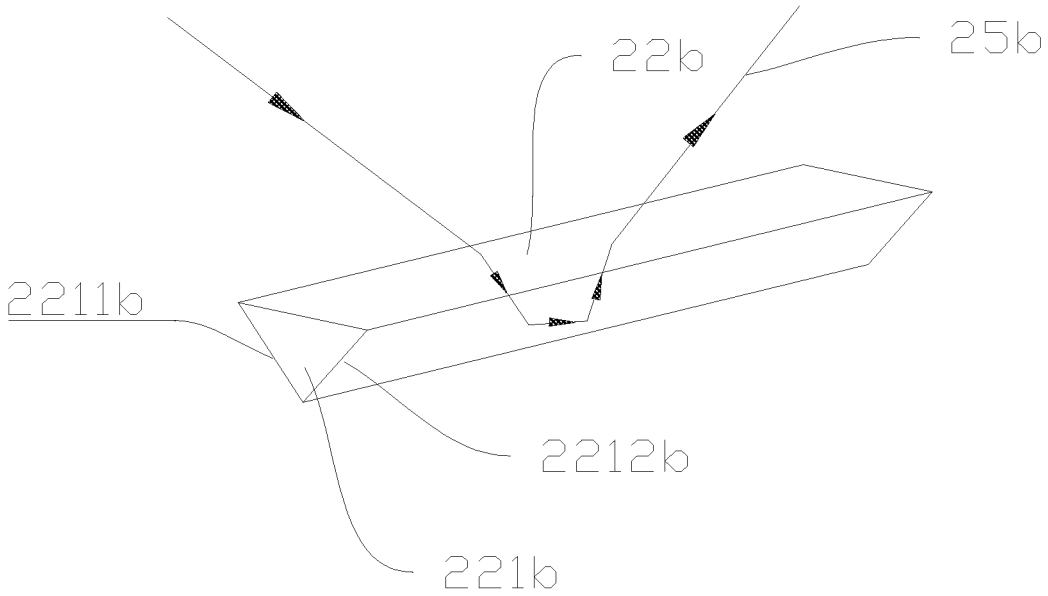
FIG. 9 is a reflection schematic diagram of the reflector according to the second example of the present disclosure.

The principle of total reflection by the coaming 202*b* is as shown in FIG. 9, in a case that the light is irradiated onto the second light exit surface 22*b*, the light is refracted to enter a first tooth surface 2211*b*, then the light is reflected totally by the first tooth surface 2211*b* to the second tooth surface 2212*b*, then the light is reflected totally by the second tooth surface 2212*b* to the second light exit surface 22*b*, the second exited light 25*b* is refracted from the second light exit surface 22*b*, and an included angle between the second exited light 25*b* and the second light exit surface 22*b* is the same as the included angle between the light irradiated to the second light exit surface 22*b* and the second light exit surface 22*b*, which is equivalent to that the light is reflected totally on the second light exit surface 22*b*.

The collimating lens 10*b* plays a role in adjusting the direction of the light emitted by the light source 32*b*, the outer side surface of the collimating lens 10*b* is a conical surface 12*b*, the conical surface 12*b* inclines outward, and the outer diameter of the collimating lens 10*b* increases gradually in a direction from the inner end to the outer end.

As shown in FIG. 5, the first light entry surface 111*b* protrudes towards the inner end surface of the collimating lens 10*b*; and an irradiating angle range of the light source 32*b* to the first light entry surface 111*b* may be 30 degrees to 90 degrees, and the incident light 14*b* entering the first light entry surface 111*b* is irradiated to the first light exit surface 21*b* in a direction perpendicular to the first light exit surface 21*b*, and continuously emit along a direction perpendicular to the first light exit surface 21*b* for key lighting. The light emitted from the first light exit surface 21*b* is first exited light 24*b*.

As shown in FIG. 5, the light that is emitted by the light source 32*b* outside the first light entry surface 111*b* is irradiated to the second light entry surface 112*b*. For example, in a case that an angle of the light emitted by the light source 32*b* to the first light entry surface 111*b* is 30 degrees, the remaining light in a total angle of 150 degrees is irradiated to the second light entry surface 112*b*. In a case that the angle of the light emitted by the light source 32*b* to the first light entry surface 111*b* is 90 degrees, the remaining light in a total angle of 90 degrees is irradiated to the second light entry surface 112*b*. The incident light 14*a* entering the second light entry surface 112 is irradiated to the conical surface 12*b*, reflected totally on the conical surface 12*b* so as to be irradiated to the second light exit surface 22*b* in a direction of forming an included angle of 45 degrees with the second light exit surface 22*b*, and reflected totally on the second light exit surface 22, and further emit in a direction parallel to the ceiling 40. The light reflected by the second light exit surface 22*b* is second exited light 25*b*, and the second exited light 25*b* is parallel to the surface of the ceiling 40, which has the advantage that compared with the case where an included angle is formed between the second exited light 25*b* and the surface of the ceiling 40, the second exited light 25*b* is parallel to the surface of the ceiling 40, so that a lightened area of the ceiling 40 can be enlarged.

The first exited light 24*b* is perpendicular to the second exited light 25*b*. Because the ground is parallel to the ceiling 40, the first exited light 24*b* is irradiated to the ground perpendicularly for key lighting.

The periphery of the reflector 20*b* is connected with a mounting cylinder 50*b*, the mounting cylinder 50*b* may be transparent, the mounting cylinder 50*b* may also be opaque, and the mounting cylinder 50*b* can be made of a light-transmitting material. As shown in FIG. 5, the reflector 20*b* and the mounting cylinder 50*b* may be integrated. The reflector 20*b* and the mounting cylinder 50*b* may also be separated, and may be assembled together through a connecting structure or a connecting member. The second exited light 25*b* is emitted through a side wall of the mounting cylinder 50*b*. Preferably, the second exited light 25*b* is emitted in a direction perpendicular to the mounting cylinder 50*b*. The outer surface of the mounting cylinder 50*b* is provided with a boss 51*b*.

Figure 10:
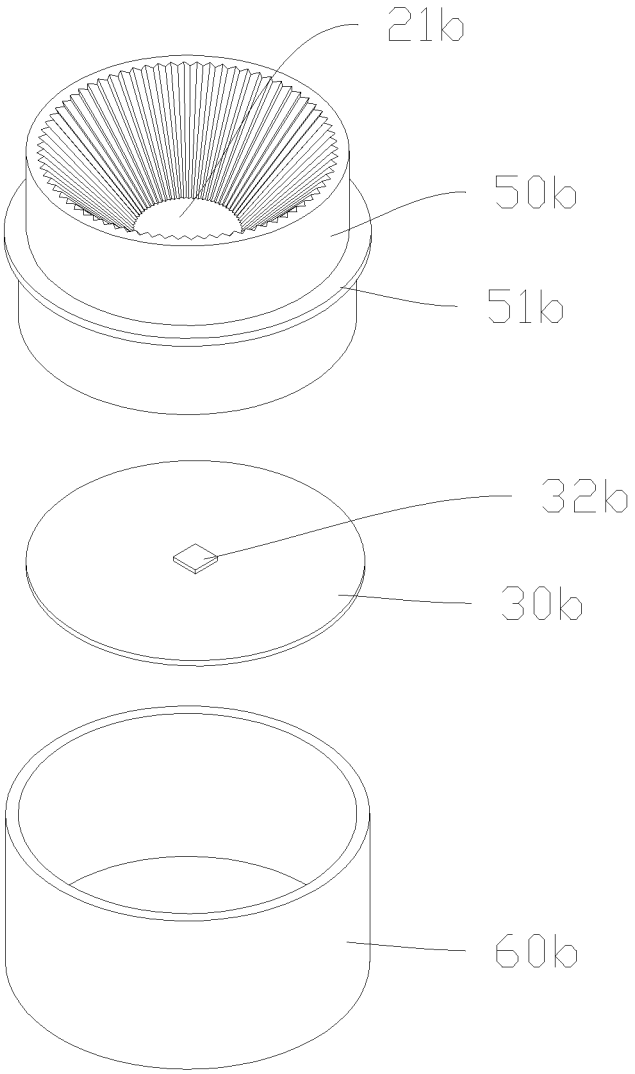
FIG. 10 is an exploded view of the lamp according to the second example of the present disclosure.

As shown in FIG. 4 and FIG. 10, the lamp further includes a shell 60*b*, and the shell 60*b* is mounted in a mounting hole of the ceiling 40. The collimating lens 10*b* is located in the shell 60*b*. The shell 60*b* includes a bottom plate and a side plate that are connected, and the light source substrate 31*b* is arranged on the inner surface of the bottom plate of the shell 60*b*. The shell 60*b* is sleeved outside the mounting cylinder 50*b*, and the end surface of the open end of the shell 60*b* is butted on the boss 51*b*. As shown in FIG. 5, the outer end surface of the boss 51*b* is butted on the inner surface of the ceiling 40, and then the second light exit surface 22*b* is exposed completely outside the shell 60*b*. The second light exit surface 22*b* extends beyond the ceiling 40, so that all of the second exited light 25*b* can be irradiated to the ceiling 40 area. The reflector 20*b* may be as transparent as the collimating lens 10*b*, and at the time, the reflector 20*b* and the collimating lens 10*b* may be integrated.

The reflector 20*b* may also be opaque, and then the reflector 20*b* and the collimating lens 10*b* are separated; and the reflector 20*b* and the collimating lens 10*b* are butted against each other, and the collimating lens 10*b*, the reflector 20*b* and the light source assembly 30*b* are assembled together through the mounting cylinder 50*b* and the shell 60*b*. The collimating lens 10*b*, the reflector 20*b* and the light source assembly 30*b* may also be assembled through other structural members.

The above is the preferred solution of the present example, and in other examples, the collimating lens 10*b* may be replaced by an ordinary lens.

In other examples, the lamp may also be a linear lamp, a wall washer lamp or other types of lamps. Both a shell and a lamp panel of the linear lamp extend along a length direction, and adaptively the shape of the light distribution element shall be adjusted as extending along the length direction.

The present disclosure provides a light distribution element, a light source module including the light distribution element and a lamp including the light source module, and the light distribution element that can improve the illumination comfort of the lamp and the light distribution element is low in cost.

A light distribution element is provided, the light distribution element includes a light entry surface, a first light exit surface and a second light exit surface, the first light exit surface is configured to receive part of light entering the light entry surface and emit the part of the light entering the light entry surface; the second light exit surface is a reflective surface, and the second light exit surface is configured to receive part of the light entering the light entry surface and reflect the part of the light entering the light entry surface; and a direction of the light emitted from the second light exit surface is different from a direction of the light emitted from the first light exit surface.

In an example of the light distribution element, the light emitted from the second light exit surface is perpendicular to the light emitted from the first light exit surface.

In an example of the light distribution element, the second light exit surface is arranged at the periphery of the first light exit surface, and the second light exit surface is inclined outward to the first light exit surface.

In an example of the light distribution element, the light distribution element comprises a collimating lens, the collimating lens is configured to allow the part of the light entering the light entry surface to be irradiated into the second light exit surface in a direction of forming an included angle of 45° with the second light exit surface.

In an example of the light distribution element, the collimating lens is configured to allow the part of the light entering the light entry surface to be irradiated into the first light exit surface in a direction perpendicular to the first light exit surface.

In an example of the light distribution element, the second light exit surface is inclined outward to the first light exit surface, and an included angle between an inclined direction of the second light exit surface and the first light exit surface is 45 degrees.

In an example of the light distribution element, the second light exit surface and the first light exit surface form a continuous surface.

In an example of the light distribution element, the light distribution element comprises a lens, an outer side surface of the lens is a conical surface inclining outward, and the conical surface is configured to receive the part of the light entering the light entry surface and reflect the light to the second light exit surface.

In an example of the light distribution element, the lens has the light entry surface, the light entry surface is recessed inward from one end surface of the lens and encloses a light source cavity, and a side surface of the light source cavity is configured to emit the light to the conical surface.

In an example of the light distribution element, a bottom surface of the light source cavity protrudes towards the end surface.

In an example of the light distribution element, the light distribution element is an integrated collimating lens.

In an example of the light distribution element, one end of the light distribution element is recessed inward from an end surface to form a light exit cavity, a bottom surface of the light exit cavity comprises the first light exit surface, and a side surface of the light exit cavity comprises the second light exit surface.

In an example of the light distribution element, the light distribution element comprises a lens and a reflector, and the lens has the light entry surface; one surface of the reflector is provided with a sawtooth, two ends of the sawtooth extend towards two ends of the reflector, and the other surface of the reflector comprises the second light exit surface.

In an example of the light distribution element, the lens and the reflector are detachably connected or integrally formed.

A light source module is provided, the light source module includes a light source and the light distribution element mentioned above, and the light entry surface is configured to receive light emitted by the light source.

A lamp is provided, the lamp includes a shell, a light source and the light distribution element mentioned above, the light entry surface is configured to receive light emitted by the light source, and the light source, the light distribution element and the shell are assembled together.

In an example of the lamp, the second light exit surface is exposed outside the shell.

In an example of the lamp, the periphery of the light distribution element is connected with a mounting cylinder, and the light reflected by the second light exit surface is emitted through a cylinder wall of the mounting cylinder.

In an example of the lamp, an outer surface of the mounting cylinder is provided with a boss, the shell is sleeved outside the mounting cylinder, and an open end of the shell is butted on the boss.

In an example of the lamp, an outer surface of the light distribution element has a step surface, the shell is sleeved outside the light distribution element, and an open end of the shell is butted on the step surface.

The light distribution element of the present disclosure has the advantages that part of light entering a light entry surface is emitted from a first light exit surface, which can be used for key lighting. The other part of light entering the light entry surface is irradiated to a second light exit surface and it can be used to illuminate the ceiling after being reflected by the second light exit surface. After the light distribution element of the present disclosure is applied to the lamp, the lamp can illuminate the ceiling area while performing the key lighting, thereby improving the illumination comfort of the whole lamp.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The above examples of the present disclosure focus on differences among the various examples. As long as different optimization features among the various examples are not contradictory, the examples can be combined to form a better example, which is not repeated here for brevity.

The above description is only examples of the present disclosure and is not used to limit the present disclosure. For those skilled in the art, various changes and variations of the present disclosure can be made. Any modifications, equivalent substitution and improvements made within the spirit and principle of the present disclosure shall be contained within the scope of the present disclosure.

What is claimed is:

1. A light distribution element, comprising a light entry surface, a first light exit surface and a second light exit surface, wherein:

the first light exit surface is configured to receive a first part of light entering the light entry surface and emit the part of the light entering the light entry surface;

the second light exit surface is a reflective surface, and the second light exit surface is configured to receive a second part of the light entering the light entry surface and reflect the part of the light entering the light entry surface; and a direction of the light emitted from the second light exit surface is different from a direction of the light emitted from the first light exit surface, wherein the light distribution element comprises a collimating lens, the collimating lens is configured to allow the part of the light entering the light entry surface to be irradiated into the second light exit surface in a direction of forming an included angle of 45° with the second light exit surface.

2. The light distribution element according to claim 1, wherein the light emitted from the second light exit surface is perpendicular to the light emitted from the first light exit surface.

3. The light distribution element according to claim 1, wherein the second light exit surface is arranged at the periphery of the first light exit surface, and the second light exit surface is inclined outward to the first light exit surface.

4. The light distribution element according to claim 1, wherein the collimating lens is configured to allow the part of the light entering the light entry surface to be irradiated into the first light exit surface in a direction perpendicular to the first light exit surface.

5. The light distribution element according to claim 4, wherein the second light exit surface is inclined outward to the first light exit surface, and an included angle between an inclined direction of the second light exit surface and the first light exit surface is 45 degrees.

6. The light distribution element according to claim 1, wherein the second light exit surface and the first light exit surface form a continuous surface.

7. The light distribution element according to claim 1, wherein the light distribution element comprises a lens, an outer side surface of the lens is a conical surface inclining outward, and the conical surface is configured to receive the part of the light entering the light entry surface and reflect the light to the second light exit surface.

8. The light distribution element according to claim 7, wherein the lens has the light entry surface, the light entry surface is recessed inward from one end surface of the lens and encloses a light source cavity, and a side surface of the light source cavity is configured to emit the light to the conical surface.

9. The light distribution element according to claim 8, wherein a bottom surface of the light source cavity protrudes towards the end surface.

10. The light distribution element according to claim 1, wherein the light distribution element is an integrated collimating lens.

11. The light distribution element according to claim 10, wherein one end of the light distribution element is recessed inward from an end surface to form a light exit cavity, a bottom surface of the light exit cavity comprises the first light exit surface, and a side surface of the light exit cavity comprises the second light exit surface.

12. The light distribution element according to claim 1, wherein the light distribution element comprises a lens and a reflector, and the lens has the light entry surface; one surface of the reflector is provided with a sawtooth, two ends of the sawtooth extend towards two ends of the reflector, and the other surface of the reflector comprises the second light exit surface.

13. The light distribution element according to claim 12, wherein the lens and the reflector are detachably connected or integrally formed.

14. A light source module, comprising a light source and a light distribution element, wherein:

the light distribution element comprises a light entry surface, a first light exit surface and a second light exit surface;

the first light exit surface is configured to receive a first part of light entering the light entry surface and emit the part of the light entering the light entry surface;

the second light exit surface is a reflective surface, and the second light exit surface is configured to receive a second part of the light entering the light entry surface and reflect the part of the light entering the light entry surface;

a direction of the light emitted from the second light exit surface is different from a direction of the light emitted from the first light exit surface; and the light entry surface is configured to receive light emitted by the light source, wherein the light distribution element comprises a collimating lens, the collimating lens is configured to allow the part of the light entering the light entry surface to be irradiated into the second light exit surface in a direction of forming an included angle of 45° with the second light exit surface.

15. A lamp, comprising a shell, a light source and a light distribution element, wherein:

the light distribution element comprises a light entry surface, a first light exit surface and a second light exit surface;

the first light exit surface is configured to receive a first part of light entering the light entry surface and emit the part of the light entering the light entry surface;

the second light exit surface is a reflective surface, and the second light exit surface is configured to receive a second part of the light entering the light entry surface and reflect the part of the light entering the light entry surface;

a direction of the light emitted from the second light exit surface is different from a direction of the light emitted from the first light exit surface; and the light entry surface is configured to receive light emitted by the light source, and the light source, the light distribution element and the shell are assembled together, wherein the light distribution element comprises a collimating lens, the collimating lens is configured to allow the part of the light entering the light entry surface to be irradiated into the second light exit surface in a direction of forming an included angle of 45° with the second light exit surface.

16. The lamp according to claim 15, wherein the second light exit surface is exposed outside the shell.

17. The lamp according to claim 15, wherein the periphery of the light distribution element is connected with a mounting cylinder, and the light reflected by the second light exit surface is emitted through a cylinder wall of the mounting cylinder.

18. The lamp according to claim 17, wherein an outer surface of the mounting cylinder is provided with a boss, the shell is sleeved outside the mounting cylinder, and an open end of the shell is butted on the boss.

19. The lamp according to claim 16, wherein an outer surface of the light distribution element has a step surface, the shell is sleeved outside the light distribution element, and an open end of the shell is butted on the step surface.

* * * * *